US005123813A

United States Patent [19]

Przytulski et al.

[11] Patent Number: 5,123,813

[45] Date of Patent: Jun. 23, 1992

[54] APPARATUS FOR PRELOADING AN AIRFOIL BLADE IN A GAS TURBINE ENGINE

[75] Inventors: James C. Przytulski, Fairfield; Martin C. Hemsworth, Cincinnati, both of Ohio

[73] Assignee: General Electric Company, Cincinnati, Ohio

[21] Appl. No.: 662,693

[22] Filed: Mar. 1, 1991

[51] Int. Cl.[5] ..... B63H 1/20

[52] U.S. Cl. ..... 416/221; 416/219 R; 416/500; 403/372

[58] Field of Search ..... 416/219 R, 220 R, 221, 416/500; 403/370, 372, 357

[56] References Cited

U.S. PATENT DOCUMENTS

| | | | |
|---|---|---|---|
| 2,846,183 | 8/1958 | Morgan | 416/221 |
| 3,252,687 | 5/1966 | Beck et al. | 253/77 |
| 3,545,884 | 12/1970 | Schroeter | 416/221 |
| 3,936,234 | 2/1976 | Tucker et al. | 416/220 |
| 4,142,827 | 3/1979 | Vinciguerra | 415/189 |
| 4,208,170 | 6/1980 | Tucker et al. | 416/221 |
| 4,245,957 | 1/1981 | Savage et al. | 416/135 |
| 4,417,854 | 11/1983 | Cain et al. | 416/221 |
| 4,836,749 | 6/1989 | Gavilan | 416/221 |

FOREIGN PATENT DOCUMENTS

| | | | |
|---|---|---|---|
| 1163439 | 9/1958 | France | 416/221 |
| 8728 | 12/1971 | Japan | 416/221 |
| 1062411 | 12/1983 | U.S.S.R. | 416/221 |

OTHER PUBLICATIONS

GE CF6-80A Engine Fan Blade Preloading (in use over one year).

*Primary Examiner*—Thomas E. Denion

*Attorney, Agent, or Firm*—Douglas E. Erickson; Jerome C. Squillaro

[57] ABSTRACT

Apparatus for preloading an airfoil blade attached to a rotor disk in a gas turbine engine. The dovetail root of a composite fan blade is preloaded to prevent rubbing and wear against the dovetail slot of a metal rotor disk during fan windmilling, with the aircraft engine off, due to wind and breezes at the airport. A resilient material is inserted into the lower portion of the slot below the engaged blade root. The disk has a radius which intersects the slot. The material is acted upon by a device which adjustably compresses the inserted material perpendicular to the radius of the disk. This causes the compressed material to exert a radially outward force against the bottom of the engaged root of the blade.

9 Claims, 8 Drawing Sheets

APPARATUS FOR PRELOADING AN AIRFOIL BLADE IN A GAS TURBINE ENGINE

BACKGROUND OF THE INVENTION

The present invention relates generally to attachment of airfoil blades in a gas turbine engine and more particularly to apparatus for radially preloading fan blades in a turbofan engine.

Existing turbofan engines include those having fan blades with dovetail roots which are inserted into corresponding dovetail slots in the fan disk of the engine. To allow for easy insertion and removal of the fan blades, the attachment arrangement necessarily requires that there be a radial space between the bottom of the engaged root of each fan blade and the bottom surface the corresponding slot in the fan disk. This results in there being some play between an attached fan blade and the fan disk. When the engine is operating, the fan blades are rotated at high speeds such that centrifugal force pushes the fan blades radially outward whereby the blade root is tightly engaged in the dovetail slot of the fan disk. However, when the engine is not operating, the fan blades are free to slowly rotate or windmill due to wind or breezes on the ground at the airport. Under such slow and varying rotation, the root of the attached fan blade rubs against and wears on the corresponding dovetail slot of the fan disk.

U.S. Pat. No. 3,936,234 preloads the fan blade with a radially outward force to eliminate wear between the blade root and the dovetail slot during windmill conditions. In that patent, the fan-blade-to-rotor attachment-/locking device includes a spacer member 32 disposed between the blade tang (root) and the bottom of the rotor (disk) slot, the spacer member 32 having a bottom recess 70 containing a biasing wedge 80 comprised of resilient material capable of elastic deformation. The biasing wedge 80 has an axial length which is too long for bottom recess 70 so that its middle bulges out of the recess (see FIG. 9). However, when the biasing wedge 80 is radially compressed between the bottom of the rotor slot and the spacer member, in the blade-locked position, it will bias the blade radially outward (see FIG. 10).

U.S. Pat. No. 4,208,170 also preloads the fan blade with a radially outward force to eliminate wear between the blade root and the dovetail slot during windmill conditions. In that patent, the fan-blade-to-rotor attachment device includes a spacer 52 made of a high-strength metallic alloy which acts as a spring. The spacer 52 is disposed between the blade tang and the bottom of the rotor slot to bias the blade radially outward.

The blade preloading apparatus disclosed in the above-described patents are not adjustable, meaning they cannot be adjusted during routine inspection to maintain a constant preload force against the root of the fan blade as the spring spacer of U.S. Pat. No. 4,208,170 and the resilient biasing wedge of U.S. Pat. No. 3,936,234 lose their resiliency over the operating lifetime of the fan blades in the engine.

SUMMARY OF THE INVENTION

It is an object of the invention to provide an adjustable radial preloading apparatus for fan blades attached to a fan disk of a turbofan engine.

The invention provides apparatus for preloading an airfoil blade attached to a rotor disk in a gas turbine engine wherein the blade has a dovetail root, the disk has a corresponding dovetail slot for engaging the root, the slot extends from one side toward the other side of the disk across its periphery, the disk includes a radius intersecting the slot, and the slot includes a lower portion providing a radial space between the bottom of the engaged root and the bottom surface of the slot. The preloading apparatus includes a resilient material insertable into the lower portion of the slot below the engaged root. The preloading apparatus also includes a device for adjustably compressing the inserted material generally perpendicular to the radius of the disk so that the compressed material exerts a radially outward force towards the bottom of the engaged root of the blade.

In a preferred embodiment, the slot extends between the sides of the disk, and there is also included two disk plates covering the ends of the slot, with each disk plate securable to a corresponding side of the disk. Also, the adjustable compressing device includes: a piston placed in the lower portion of the slot; one disk plate having a bore with internal threads; and a bolt threadably engaged in the bore, the bolt having one end with a head protruding from the one disk plate and having another end engaging the piston.

In another preferred embodiment, the adjustable compressing device includes two end plates positioned so as to bound the material therebetween, the material and one end plate each having a coaxial bore. The device also has a bolt inserted in the bores, the bolt having one end with external threads protruding from one end plate and having the other end secured to the other end plate. The device additionally has a nut threadably engaged on the one end of the bolt.

Several benefits and advantages are derived from the invention. The adjustable compressing device feature provides an opportunity during routine engine inspection to, for example, further engage the bolt of the first above-mentioned preferred embodiment or to further engage the nut of the second above-mentioned embodiment so as to keep a constant preload force on the blade root. This will prevent wear, during windmilling, due to any loss in resiliency over time in the resilient material. Also, the invention allows radial preloading of a fan blade having a circular arc dovetail root which engages a corresponding circular arc dovetail slot in the fan disk. The blade preloading apparatus of U.S. Pat. No. 3,936,234 and U.S. Pat. No. 4,208,170 appear to have been designed for fan blades having straight dovetail roots and fan disks having straight dovetail slots.

BRIEF DESCRIPTION OF THE DRAWINGS

The accompanying drawings illustrate several embodiments of the present invention wherein.

DETAILED DESCRIPTION OF THE INVENTION

Figure 1:
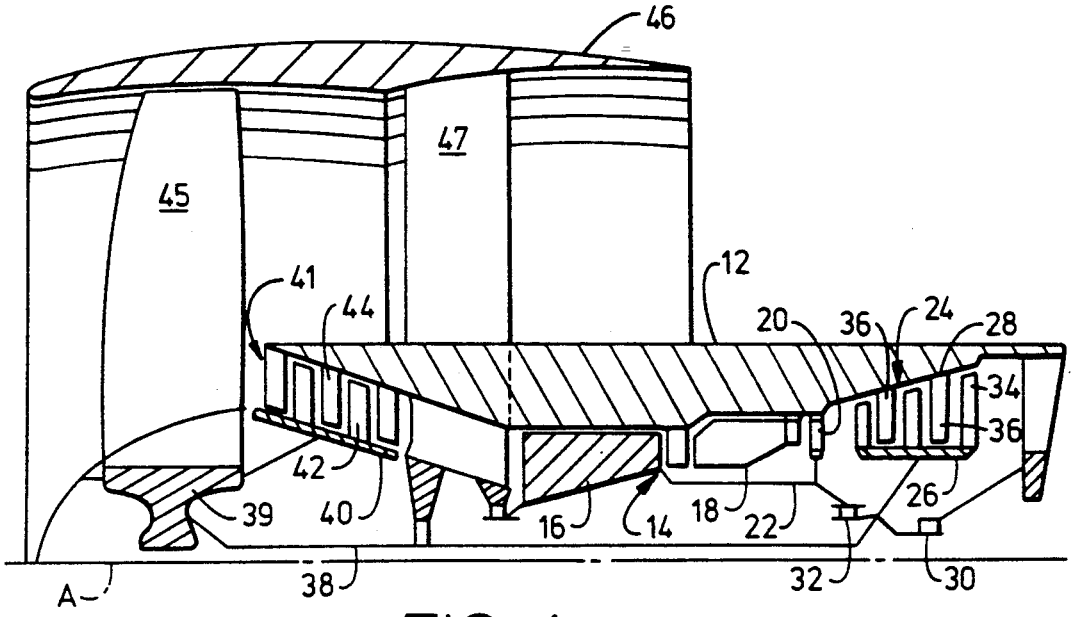
FIG. 1 is a side schematic view of a turbofan engine.

Referring now to the drawings, and particularly to FIG. 1, there is illustrated generally a gas turbine engine and particularly a turbofan engine, generally designated 10, to which the present invention can be applied. The engine 10 has a longitudinal center line or axis A and an annular casing 12 disposed coaxially and concentrically about the axis A. The engine 10 includes a core gas generator engine 14 which is comprised of a compressor 16, a combustor 18, and a high pressure turbine 20, all arranged coaxially about the longitudinal axis or center line A of the engine 10 in a serial, axial flow relationship. An annular drive shaft 22 fixedly interconnects the compressor 16 and the high pressure turbine 20.

The core engine 14 is effective for generating combustion gases. Pressurized air from the compressor 16 is mixed with fuel in the combustor 18 and ignited, thereby generating combustion gases. Some work is extracted from these gases by the high pressure turbine 20 which drives the compressor 16. The remainder of the combustion gases are discharged from the core engine 14 into a low pressure power turbine 24.

The low pressure turbine 24 includes an annular drum rotor 26 and a stator 28. The rotor 26 is rotatably mounted by suitable bearings 30 and includes a plurality of axially spaced turbine blade rows 34 extending radially outwardly therefrom. The stator 28 is disposed radially outward of the rotor 26 and has a plurality of stator vane rows 36 fixedly attached to and extending radially inward from the stationary casing 12. The stator vane rows 36 are axially spaced so as to alternate with the turbine blade rows 34. The rotor 26 is fixedly attached to drive shaft 38 and interconnected to drive shaft 22 via differential bearings 32. The drive shaft 38, in turn, rotatably drives a rotor disk 39 and an interconnected booster drum rotor 40. The booster rotor 40 forms part of a booster compressor 41 which also includes a plurality of booster blade rows 42 and booster stator vane rows 44. The booster blade rows 42 are fixedly attached to and extend radially outward from the booster rotor 40 for rotation therewith while the booster stator vane rows 44 are fixedly attached to and extend radially inward from the stationary casing 12. The booster stator vane rows 44 are axially spaced so as to alternate with the booster blade rows 42. The rotor disk 39 supports a row of fan blades 45 that is housed within a nacelle 46 supported about the stationary casing 12 by a plurality of struts 47, only one of which is shown.

Figure 2B:
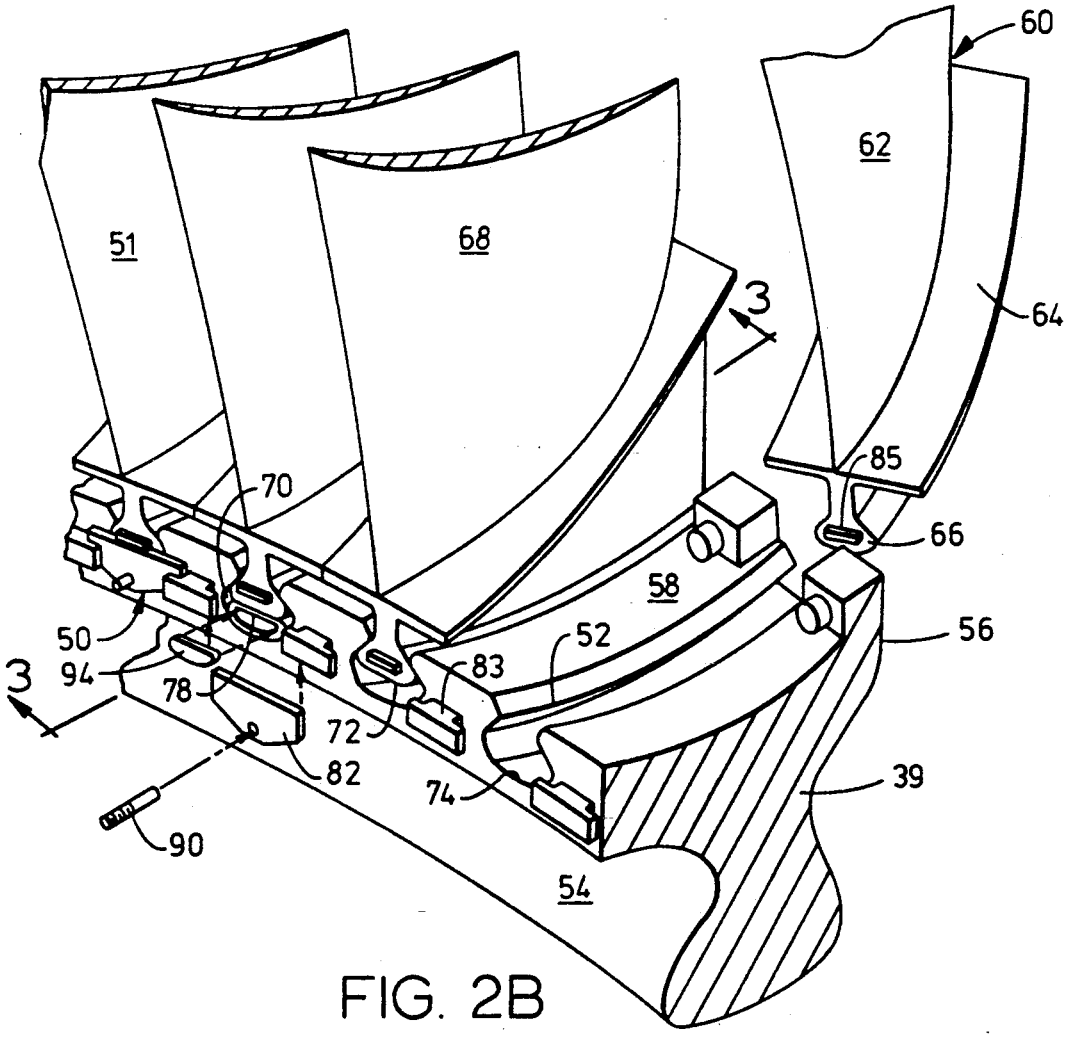
FIG. 2*b* is a cut-away perspective view of part of the fan disk of FIG. 2*a* together with a preloaded, an attached, and a removed fan blade.
Figure 2A:
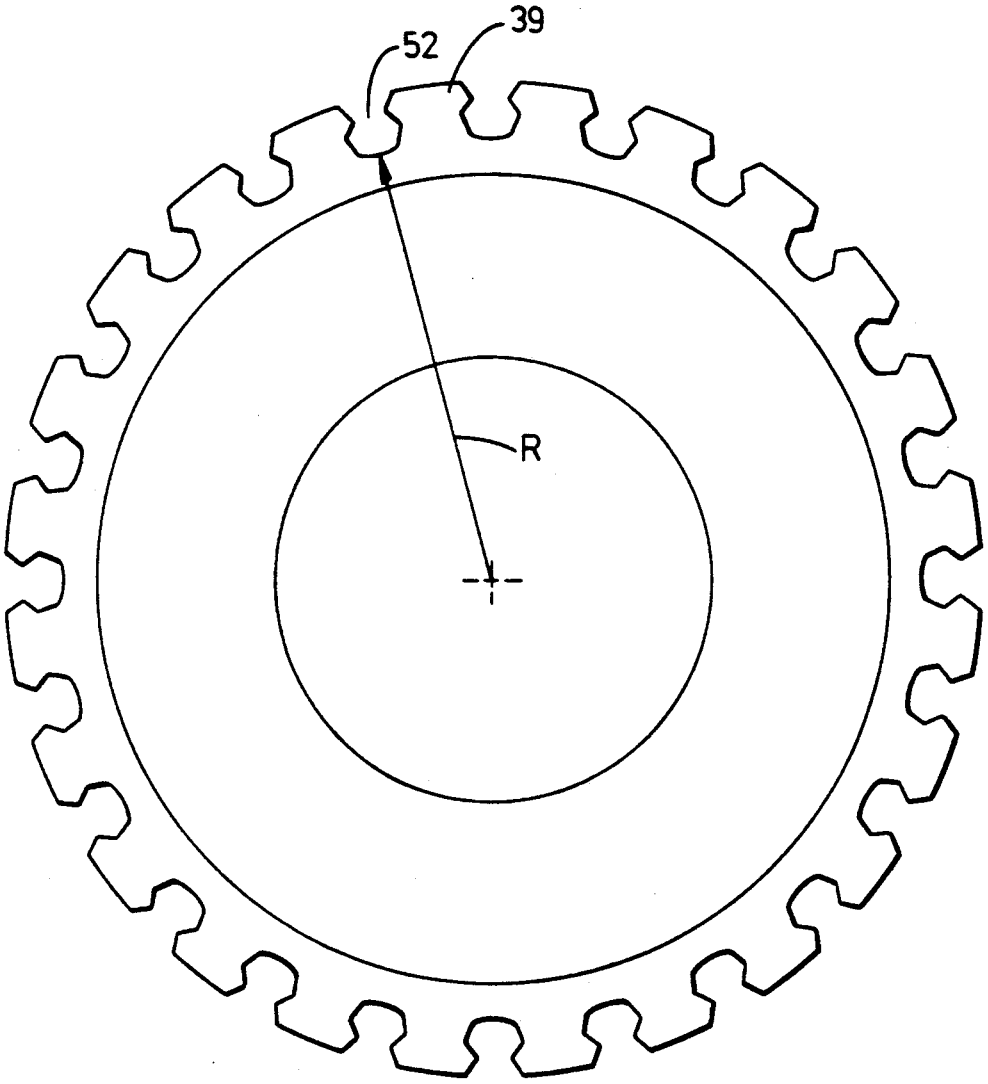
FIG. 2*a* is a front view of the fan disk of FIG. 1.
Figure 3:
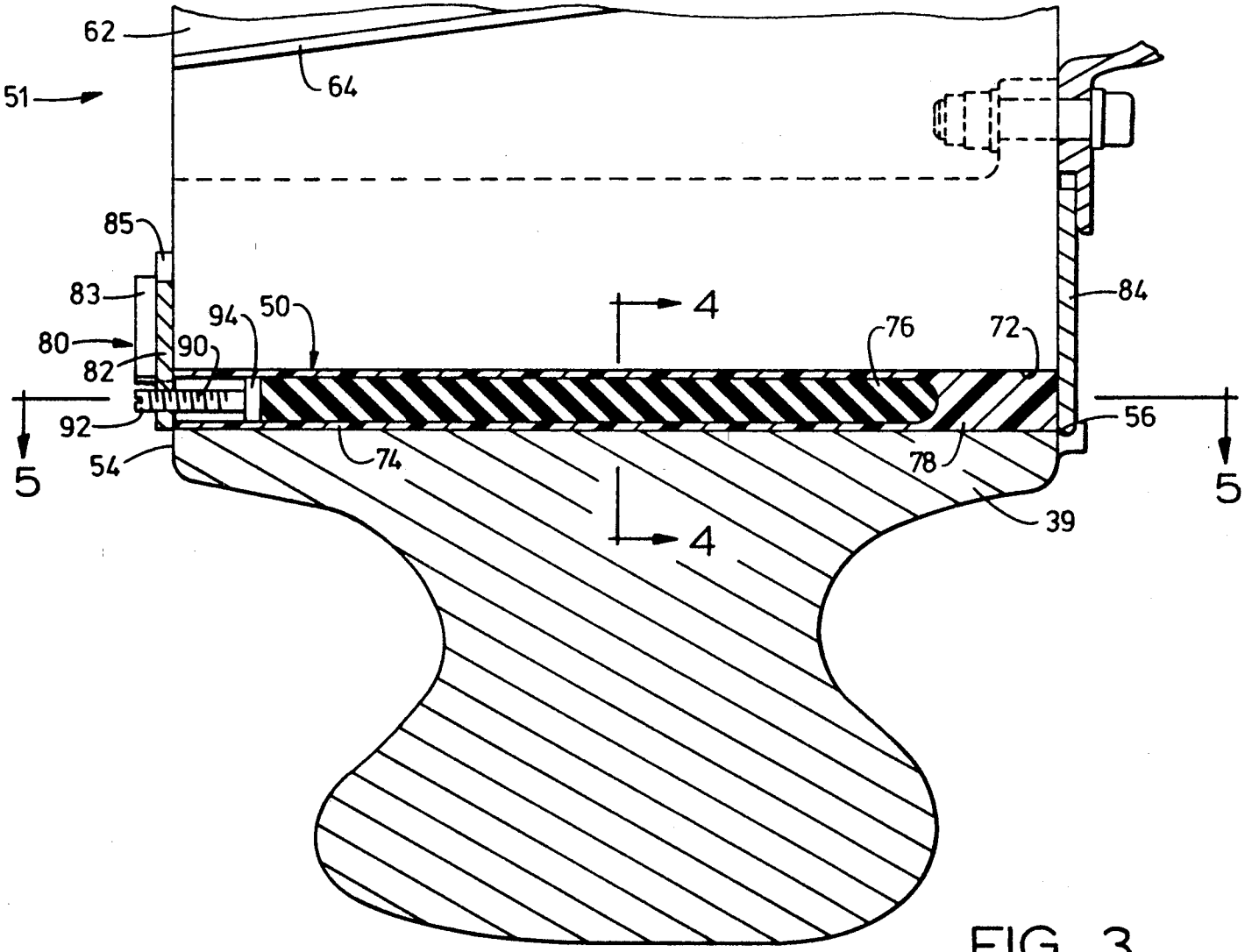
FIG. 3 is a side cross-sectional view of the fan disk and a portion of the preloaded fan blade of FIG. 2*b* taken along line 3—3 of FIG. 2*b;*
Figure 4:
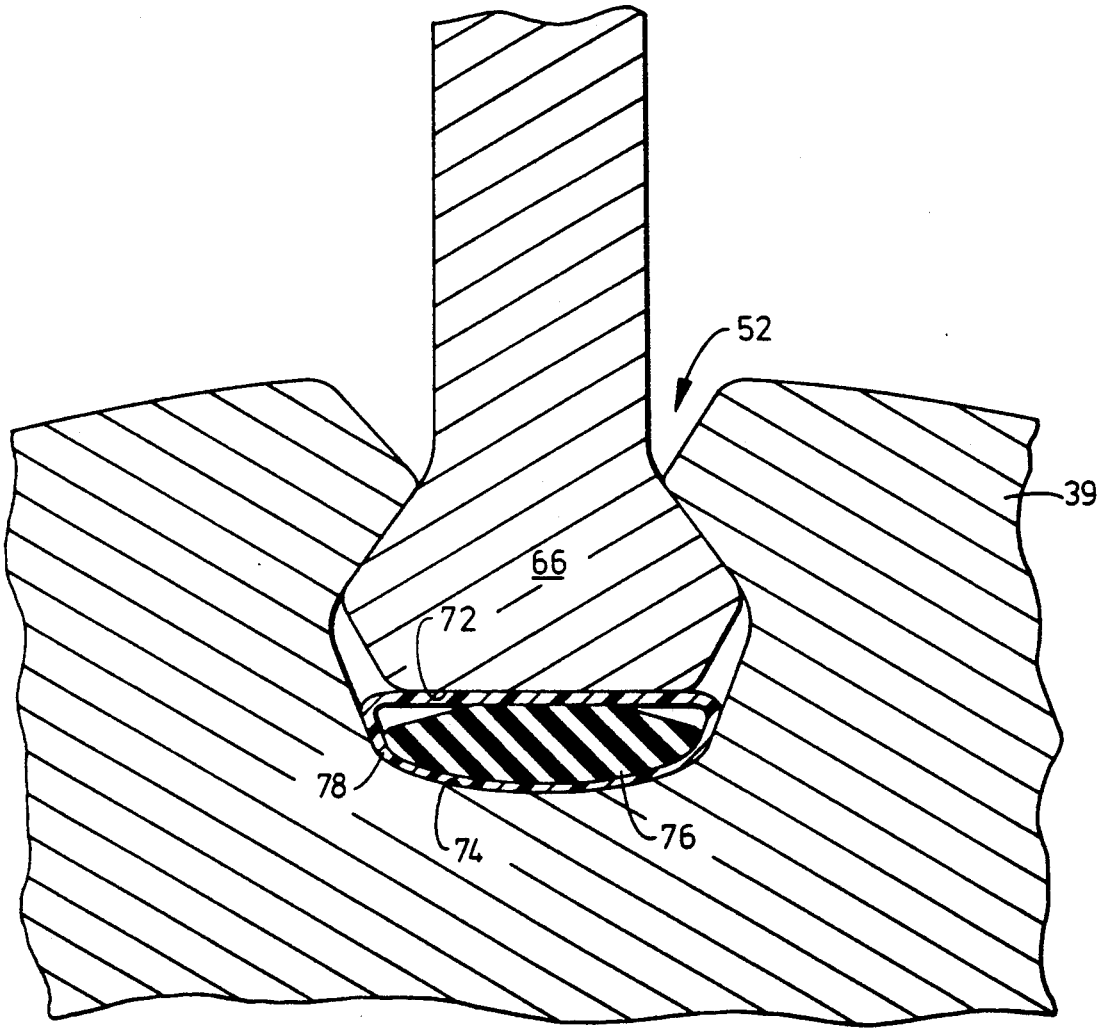
FIG. 4 is a front cross-sectional view of a portion of the fan disk and a portion of the preloaded fan blade of FIGS. 2*b* and 3 taken along line 4—4 of FIG. 3.
Figure 5:
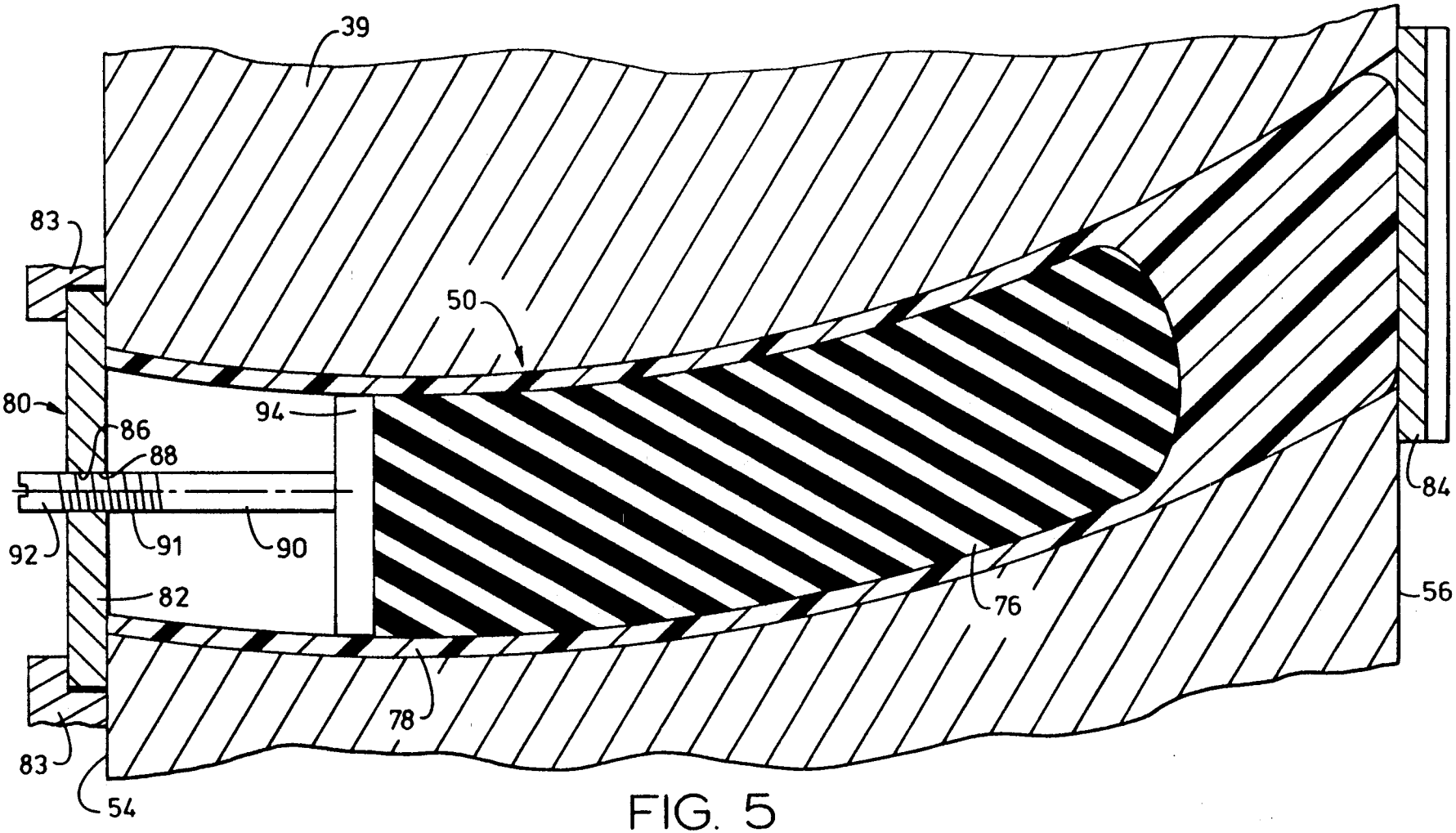
FIG. 5 is a top cross-sectional view of a portion of the fan disk of FIGS. 2*b* and 3 taken along line 5—5 of FIG. 3.

Referring now to FIGS. 2*a* and 2*b*, there is illustrated a first embodiment of the invention which comprises apparatus, generally denoted at 50, for preloading an attached airfoil blade, such as an attached fan blade 51, which is attached to a rotor disk, such as a fan rotor disk 39, in a gas turbine engine, such as the turbofan engine 10 of FIG. 1. It is noted that the invention is also applicable to other types of gas turbine engines, such as turbojets, turboprops, turboshafts, and the like, and the invention is applicable as well to other airfoil blades such as booster, compressor and/or turbine blades. The invention is especially applicable to composite blades attached to metal rotor disks because of greater blade wear from rubbing along a composite-to-metal attachment during windmilling. Materials for typical composite blades include graphite fibers bonded by polymer resins, and materials for typical metal disks include titanium, steel, and nickel alloys.

In FIGS. 2*a* and 2*b*, the fan rotor disk 39 has a plurality of circumferentially spaced apart dovetail slots 52 each extending from one side 54 of the disk 39 toward, and preferably to, the other side 56 across its periphery 58. In FIG. 2*a* the disk 39 is shown to have a radius R which intersects the slot 52. The dovetail slots 52 are seen to be circular arc dovetail slots meaning that the slots are seen to be arcs of a circle when viewing the disk on its edge. However, the invention is equally applicable to slots having a straight line or other shaped arc. The disk 39 holds one row of fan blades. The unattached fan blade 60 is shown to include an airfoil portion 62, a blade platform portion 64, and a circular arc dovetail root 66 to be engaged by a corresponding circular arc dovetail slot 52 which extends between the sides 54 and 56 of the disk 39. During assembly, the fan blade slidingly engages the slot 52 producing an attached, but not preloaded, fan blade 68. It is noted that the slot 52 includes a lower portion 70 which provides a radial space between the bottom 72 of the engaged root 66 and the bottom surface 74 of the slot 52.

The fan blade preloading apparatus 50 is seen in greater detail in FIGS. 2*b*, 3, 4, and 5. The apparatus 50 includes a resilient material 76 inserted into the lower portion 70 of the slot 52 below the engaged root 66 of the fan blade 51. The composition of the resilient material 76 is not considered part of the invention, and it may be comprised of any elastomeric material such as polyphosphazene-based elastomer compositions. In an exemplary embodiment, the resilient material 76 is first disposed in a flexible sack 78 which has a coefficient of friction less than that of the resilient material 76 and which, therefore, is more easily inserted into the lower portion 70 of the slot 52 below the engaged root 66 of the fan blade 51. Again, the composition of the flexible sack 78 is not considered part of the invention, and it may be comprised of such materials as polytetrafluoroethylene. When inserted into the lower portion 70 of the slot 52, the resilient material 76, whether or not first disposed in a flexible sack 78, is in a relatively relaxed state not exerting any preload on the attached fan blade.

The fan blade preloading apparatus 50 also includes means 80 for adjustably compressing the inserted material 76 generally perpendicular to the radius R of the disk 39 so that the compressed material 76 exerts a radially outward force towards the bottom 72 of the engaged root 66 of the blade 51. In an exemplary embodiment, preloading apparatus 50 also includes two disk plates 82 and 84 covering the ends of the slot 52. The disk plates 82 and 84 are securable to a corresponding side 54 and 56 of the disk 39. Conventional blade retainers could serve as the basis for disk plates, as can be appreciated by those skilled in the art.

Preferably, compressing means 80 includes one of the disk plates 82 having a bore 86 with internal threads 88. Compressing means 80 also includes a bolt 90 which has external threads 91 and which is threadably engaged in the bore 86 with the bolt 90 having one end with a head 92 which protrudes from the one disk plate 82. Compressing means 80 additionally includes a piston 94 which is disposed in the lower portion 70 of the slot 52 and which is engaged by the other end of the bolt 90. By turning the bolt head 92 with a suitable tool, the resilient material 76 is adjustably compressed which causes it to exert a radially outward force towards the bottom 72 of the engaged root 66 of the blade 51. As the material 76 loses some of its resiliency over time, the bolt head 92 can be further tightened, during routine engine inspection and maintenance, to maintain the blade 51 under a generally constant radially outward preload. It is seen in FIG. 2*b* that an installed disk plate 82 is bounded by adjacent disk lugs 83 and a blade lug 85 and would be secured against the disk lugs 83 by the action of the bolt 90 threaded to the disk plate 82 when the engaged piston 94 compresses the resilient material 76. Alternatively, the disk plate 82 could be simply bolted to the side 54 of the fan rotor disk 39 in a manner similar to that shown in FIG. 3 for disk plate 84. For these embodiments of the invention, the compressed material 76 (i.e., the resilient material 76 in its compressed state) would typically have a length greater than half the length of the slot 52 and the flexible sack 78 would contact the engaged root 66 of the blade 51.

It is noted that the greater the length of the compressed material 76, the larger will be the area of the blade root 66 contacted by the radial preload force and hence the lower will be the level of contact stress on the blade root. A low level of contact stress allows the use of composite blades. Prior art preload devices exerted their preload force on a small area of the blade root which is acceptable for metal blades but which may not be acceptable for composite blades.

Figure 6:
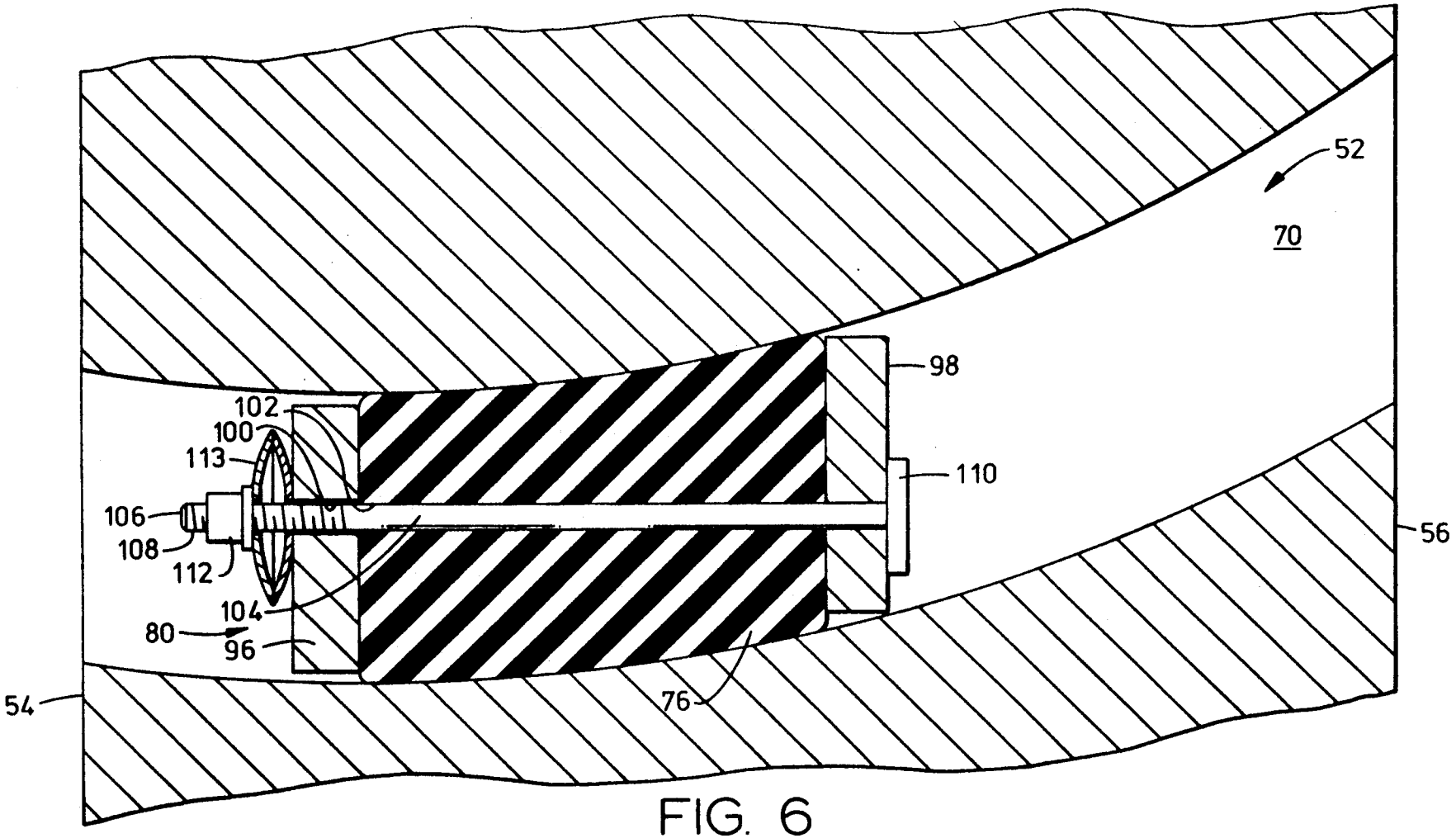
FIG. 6 is the view of FIG. 5 for an alternate embodiment of the fan blade preloading apparatus.
Figure 7:
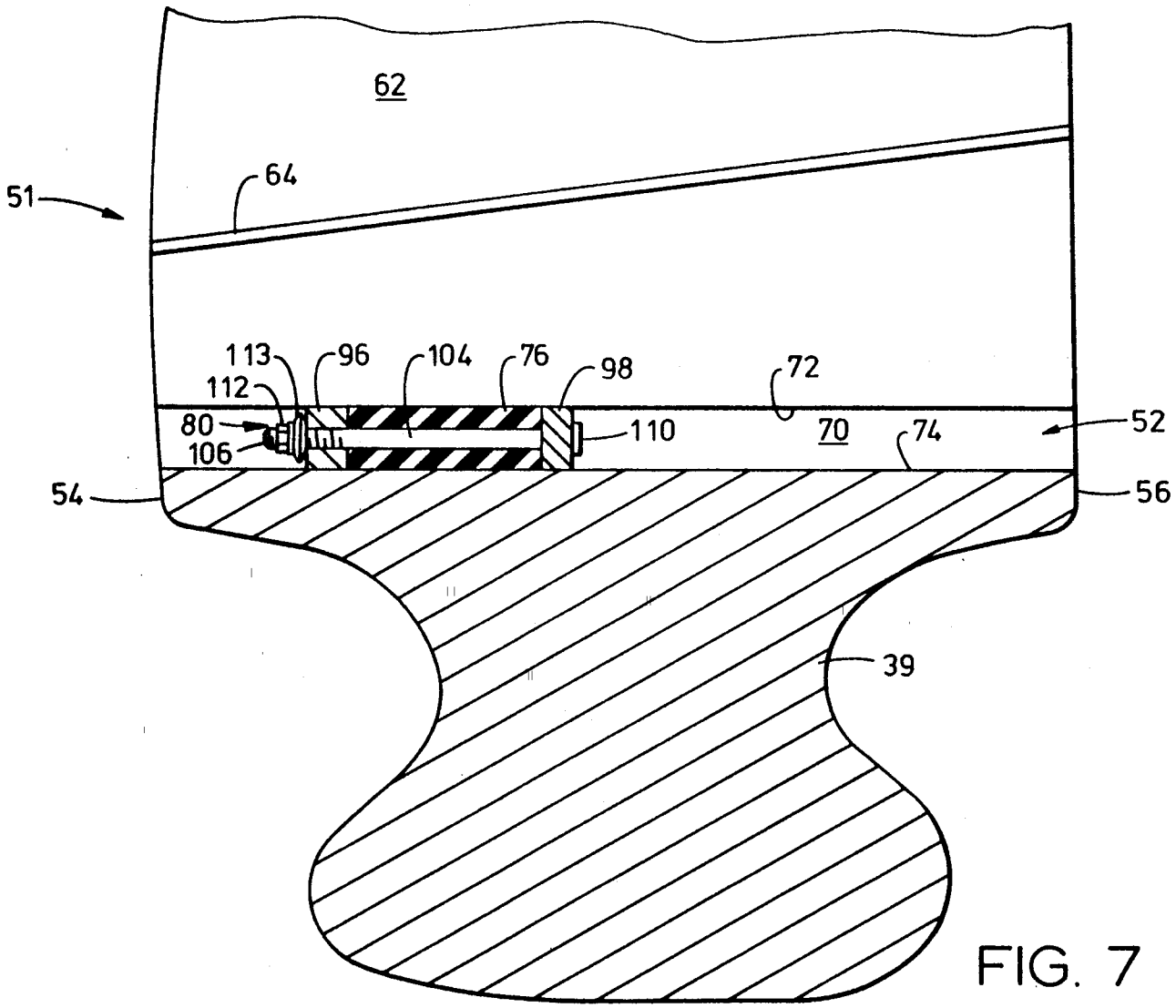
FIG. 7 is the view of FIG. 3 for the alternate embodiment of the fan blade preloading apparatus of FIG. 6.

In a second embodiment of the invention, as seen in FIGS. 6 and 7, compressing means 80 includes two end plates 96 and 98 which are disposed in the lower portion 70 of the slot 52 so as to bound the resilient material 76 therebetween. One of the end plates 96 and the resilient material 76 each have a coaxial bore 100 and 102. A bolt 104 is inserted in the bores 100 and 102 with the bolt having one end 106 with external threads 108 protruding from the one end plate 96 and with the bolt having its other end 110 secured to the other end plate 98. In this embodiment, the compressing means 80 also includes a nut 112 which is threadably engaged on the one end 106 of the bolt 104. By turning the nut 112 with a suitable tool, the resilient material 76 is adjustably compressed which causes it to exert a radially outward force towards and against the bottom 72 of the engaged root 66 of the blade 51. As the material 76 loses some of its resiliency over time and the blade root 66 and disk slot 52 pressure faces wear during normal engine operation, the nut 112 can be further tightened, during routine engine inspection and maintenance, to maintain the blade 51 under a generally constant radially outward preload. In this embodiment of the invention, the compressed material 76 (i.e., the resilient material 76 in its compressed state) would typically have a length less than half the length of the slot 52 and the compressed material 76 itself would contact the engaged root 66 of the blade 51.

It is noted that the compressing means 80 may include a spring 113 disposed between the nut 112 and the one end plate 96. The spring 113 may comprise two preformed plates (as shown in FIG. 6) or a coil spring and the like. The spring 113 provides a self-adjusting feature which imparts a generally constant load on the one end plate 96 for limited loss of resiliency of the material 76 and limited wear of the blade root 66 and disk slot 52. This reduces the number of times the nut 112 would need to be tightened.

Other compressing means 80 include hydraulic or other mechanically driven devices and the like which compress the resilient material 76 generally along the width of the slot 52 or generally along its length, as can be appreciated by those skilled in the art.

Figure 8:
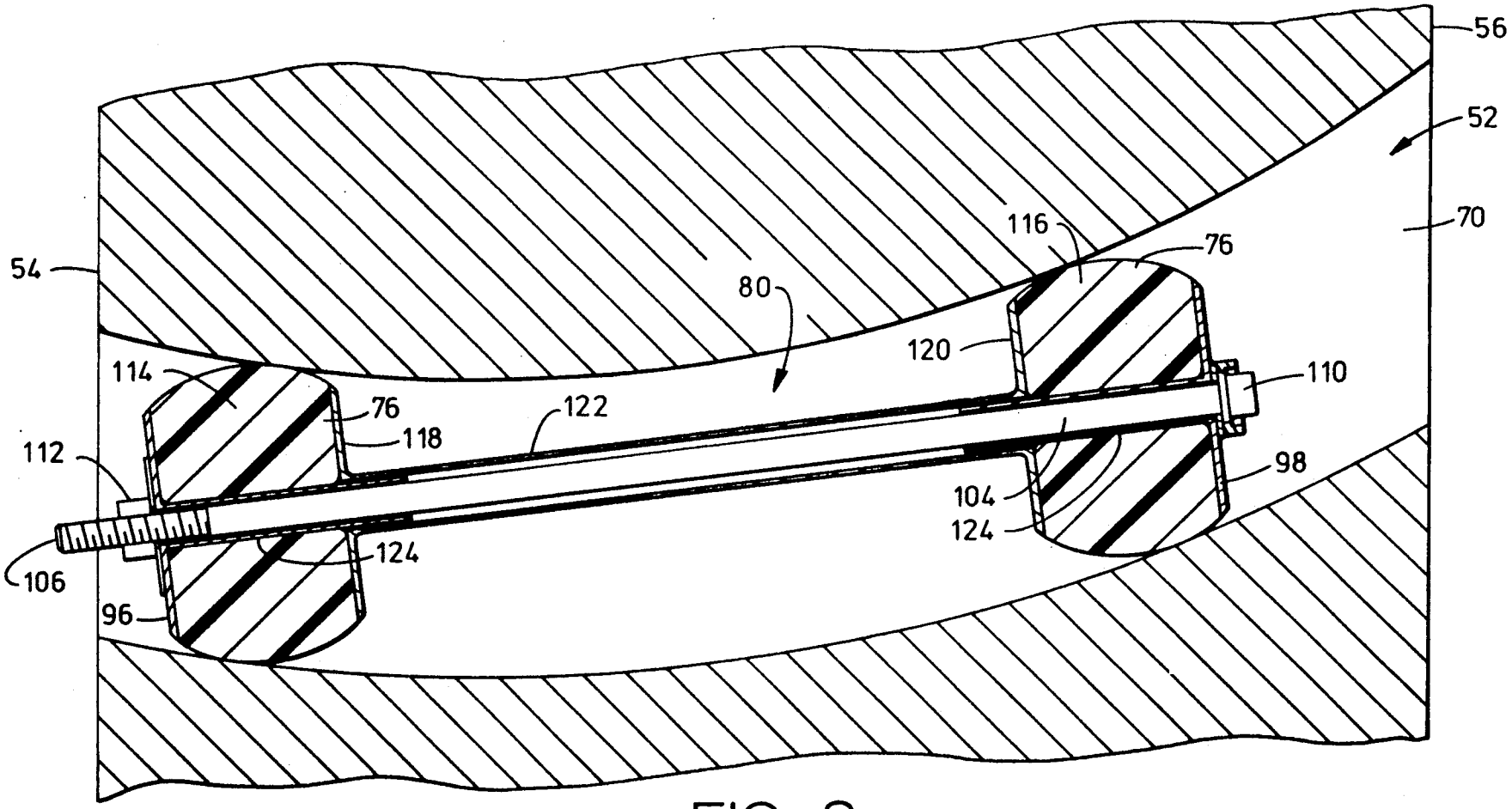
FIG. 8 is the view of FIG. 5 for a modification of the alternate embodiment of FIG. 6.

In a modification, as seen in FIG. 8, of the previously discussed second embodiment, the resilient material 76 includes two spaced-apart portions 114 and 116. Portion 114 is bounded by the one end plate 96 and one of two mid plates 118 while the other portion 116 is bounded by the other end plate 98 and the other of the two mid plates 120. The mid plates 118 and 120 are slidingly mounted on the bolt 104. A spacer tube 122 coaxially surrounds the bolt 104 between the mid plates 118 and 120. The use of two-spaced apart portions 114 and 116 of the resilient material 76 allows selective positioning of the preload force on the blade root 66. More than two spaced-apart portions may be used. Short guide tubes 124 may be attached to the end plates 96 and 98 coaxially between the bolt 104 and the spacer tube 122 to facilitate assembly.

The foregoing description of several preferred embodiments of the invention has been presented for purposes of illustration. It is not intended to be exhaustive or to limit the invention in the precise form disclosed, and obviously many modifications and variations are possible in light of the above teaching. It is intended that the scope of the invention be defined by the claims appended hereto.

I claim:

1. Apparatus for preloading an airfoil blade attached to a rotor disk in a gas turbine engine, wherein said blade has a dovetail root, said disk has a corresponding dovetail slot for engaging said root, said slot extends from one side toward the other side of said disk across its periphery, said disk includes a radium intersecting said slot, and said slot includes a lower portion providing a radial space between the bottom of said engaged root and the bottom surface of said slot, and wherein said apparatus comprises:

(a) a resilient material insertable into said lower portion of said slot below said engaged root; and (b) means for adjustably compressing said inserted material generally perpendicular to said radius of said disk so that said compressed material exerts a radially outward force towards the bottom of said engaged root of said blade, wherein said means include:

(a) two end plates disposed so as to bound said material therebetween, said material and one said end plate each having a coaxial bore;

(b) a bolt inserted in said bores, said bolt having one end with external threads protruding from said one end plate and having the other end secured to said other end plate; and (c) a nut threadably engaged on said one end of said bolt.

2. The apparatus of claim 1, wherein said means include a spring disposed between said nut and said one end plate.

3. The apparatus of claim 1, wherein said material includes two spaced-apart portions and also including:

(a) two mid plates slidingly mounted on said bolt, one of said portions bounded by one of said mid plates and said one end plate and the other of said portions bounded by the other of said mid plates and said other end plate; and (b) a spacer tube coaxially surrounding said bolt between said mid plates.

4. The apparatus of claim 1, wherein said compressed material has a length less than half that of said slot and contacts said engaged root of said blade.

5. Apparatus for preloading an airfoil blade attached to a rotor disk in a gas turbine engine, wherein said blade has a dovetail root, said disk has a corresponding dovetail slot for engaging said root, said slot extends from one side toward the other side of said disk across its periphery, said disk includes a radius intersecting said slot, and said slot includes a lower portion providing a radial space between the bottom of said engaged root and the bottom surface of said slot, and wherein said apparatus comprises:

(a) a resilient material insertable into said lower portion of said slot below said engaged root; and (b) means for adjustably compressing said inserted material generally perpendicular to said radius of said disk so that said compressed material exerts a radially outward force towards the bottom of said engaged root of said blade, wherein said slot extends between said slides of said disk and also including two disk plates covering the ends of said slot, with each said disk plate secured to a corresponding said side of said disk, and wherein said means include:

(a) a piston disposed in said lower portion of said slot;

(b) one said disk plate having a bore with internal threads; and (c) a bolt threadably engaged in said bore, said bolt having one end with a head protruding form said one disk plate and having another end engaging said piston.

6. The apparatus of claim 5, also including a flexible sack having a coefficient of friction less than that of said material, with said material disposed in said sack and said sack inserted in said lower portion of said slot below said engaged root.

7. The apparatus of claim 6, wherein said compressed material has a length greater than half that of said slot and said sack contacts said engaged root of said blade.

8. Apparatus for preloading a composite fan blade attached to a metal rotor disk in a turbofan engine, wherein said blade has a dovetail root, said disk has a corresponding dovetail slot for engaging said root, said slot extends from one side toward the other side of said disk across its periphery, said disk includes a radius intersecting said slot, and said slot includes a lower portion providing a radial space between the bottom of said engaged root and the bottom surface of said slot, and wherein said apparatus comprises:

(a) a resilient material inserted into said lower portion of said slot below said engaged root; and (b) means for adjustably compressing said inserted material generally perpendicular to said radius of said disk so that said compressed material exerts a radially outward force against the bottom of said engaged root of said blade, and wherein said means include:

(1) two end plates disposed so as to bound said material therebetween, said material and one said end plate each having a coaxial bore;

(2) a bolt inserted in said bores, said bolt having one end with external threads protruding from said one end plate and having the other end secured to said other end plate;

(3) a nut threadably engaged on said one end of said bolt, and (4) a spring disposed between said nut and said one end plate, and wherein said compressed material has a length less than half that of said slot and contacts said engaged root of said blade.

9. Apparatus for preloading a composite fan blade attached to a metal rotor disk in a turbofan engine, wherein said blade has a dovetail root, said disk has a corresponding dovetail slot for engaging said root, said slot extends from one side to the other side of said disk across its periphery, said disk includes a radius intersecting said slot, and said slot includes a lower portion providing a radial space between the bottom of said engaged root and the bottom surface of said slot, and wherein said apparatus comprises:

(a) a resilient material;

(b) a flexible sack having a coefficient of friction less than that of said material, with said material disposed in said sack and said sack inserted in said lower portion of said slot below said engaged root;

(c) two disk plates covering the ends of said slot, with each said disk plate secured to a corresponding said side of said disk; and (b) means for adjustably compressing said inserted material generally perpendicular to said radius of said disk so that said compressed material exerts a radially outward force towards the bottom of said engaged root of said blade, and wherein said means include:

(1) a piston disposed in said lower portion of said slot;

(2) one said disk plate having a bore with internal threads; and (3) a bolt threadably engaged in said bore, said bolt having one end with a head protruding from said one disk plate and having another end engaging said piston, and wherein said compressed material has a length greater than half that of said slot and said sack contacts said engaged root of said blade.

* * * * *